United States Patent [19]

Leclair

[11] 4,118,936

[45] Oct. 10, 1978

[54] SURGE TANK FOR PNEUMATICALLY OPERATED MOTORS

[75] Inventor: Robert A. Leclair, Gainesville, Fla.

[73] Assignee: General Electric Company, Gainesville, Fla.

[21] Appl. No.: 783,088

[22] Filed: Mar. 31, 1977

[51] Int. Cl.[2] ..... F01B 21/00

[52] U.S. Cl. ..... 60/720; 60/407; 248/2; 269/20

[58] Field of Search ..... 60/407, 409, 412, 413, 60/478, DIG. 10, 698, 701, 720; 248/2, 12, 13, 127; 269/20, 289 R

[56] References Cited

U.S. PATENT DOCUMENTS

| | | | |
|---|---|---|---|
| 1,035,431 | 8/1912 | Ericson | 60/398 X |
| 2,112,633 | 3/1938 | Moon | 60/409 X |
| 2,329,709 | 9/1943 | Fischer | 60/DIG. 10 |
| 2,731,892 | 1/1956 | Simmonds | 60/412 X |

*Primary Examiner*—Edgar W. Geoghegan
*Attorney, Agent, or Firm*—Morgan, Finnegan, Pine, Foley & Lee

[57] ABSTRACT

A surge tank for a plurality of pneumatically operated motors which impart motion to a machine. The tank comprises at least one portion of a support table for the machine.

6 Claims, 1 Drawing Figure

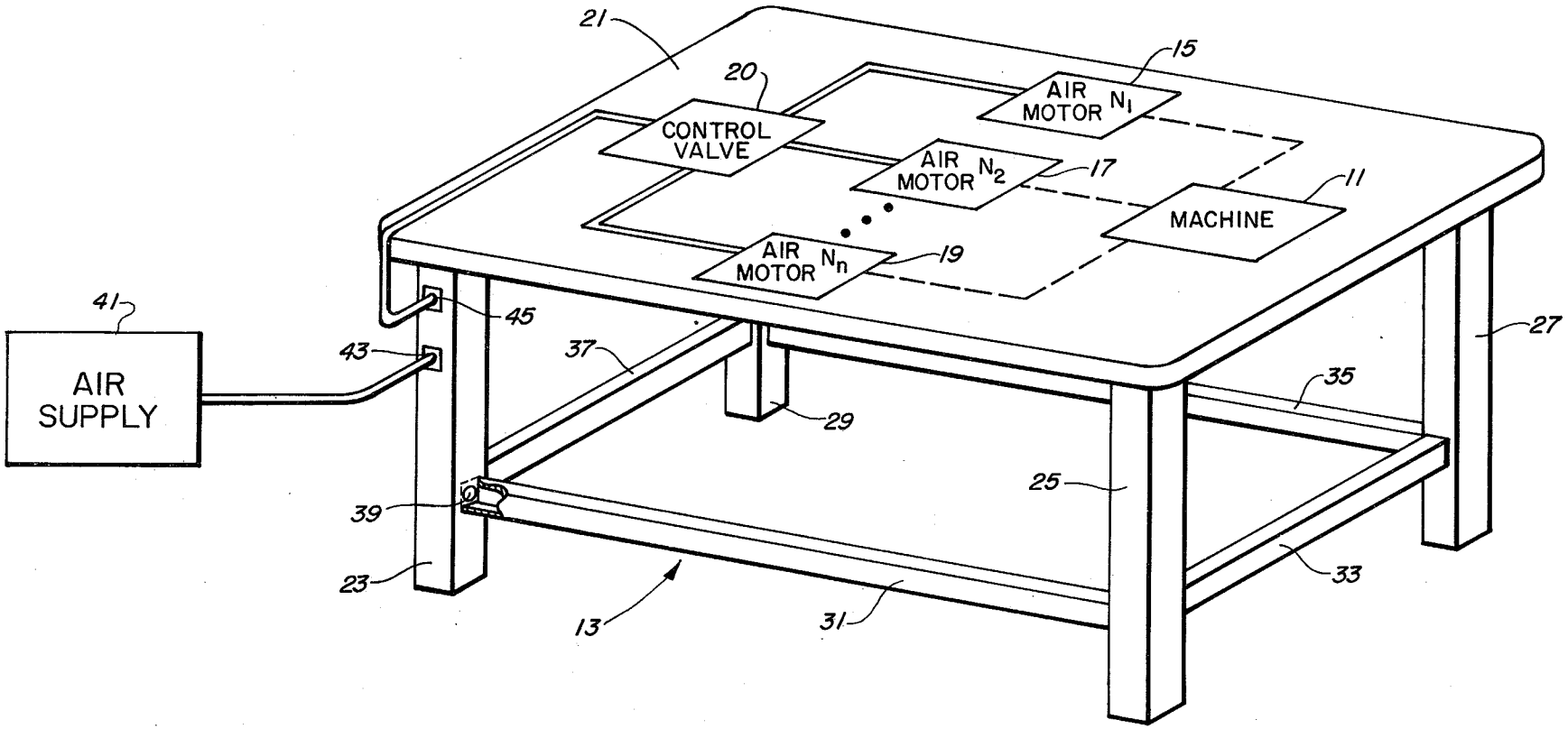
MACHINE
AIR MOTOR $N_1$
AIR MOTOR $N_2$
AIR MOTOR $N_n$
CONTROL VALVE
AIR SUPPLY
11
13
15
17
19
20
21
23
25
27
29
31
33
35
37
39
41
43
45

SURGE TANK FOR PNEUMATICALLY OPERATED MOTORS

BACKGROUND OF THE INVENTION

This invention relates to pneumatically operated machines and more particularly to surge tanks for pneumatically operated motors.

An air motor is defined as a device for imparting motion responsive to air pressure applied to the device.

A surge tank is defined as an air storage reservoir at the down stream end of a supply or a feeder pipe of a supply to prevent variations in pressure and to furnish air quickly and in sufficient volume to a pneumatically operated motor. Examples of air motors are air cylinders, turbines, and air vibrators.

In complex multi-function automated machines, air motors are often used to activate the individual functions of the machines. The function may be required to be activated either simultaneously or sequentially. When a plurality of air motors are simultaneously operated from a central air supply as is typical, it is necessary to provide a surge tank to provide an adequate volume of air within a required pressure range. Without such, the air motors may not be properly actuated because of the unavailability of the minimum air volume within a predetermined pressure range required to enable actuation of the motors.

In prior art systems, a surge tank is typically provided by an air reservoir or tank of a predetermined volume interconnected between a central air supply, via a control valve to each of the air motors to be operated from the air supply. Such prior systems have been found to be disadvantageous because of the added space and complexity such a surge tank adds to the work station of complex machinery.

Accordingly, it is the object of this invention to provide a simple, space-efficient surge tank for air motors.

SUMMARY OF THE INVENTION

These and other objects of the invention, which will be apparent from the consideration of the detailed description herein below and accompanying claims, are accomplished by an apparatus comprising a machine; a support adapted to be positioned on a floor for supporting at least a portion of the machine at a position spaced above the floor, the support comprising as an integral part, a surge tank; a plurality of pneumatically operated motors for imparting motion to the machine each being connected to the surge tank. In a preferred embodiment, the machine support is a table with tubular legs and supporting rails with the surge tank being formed by at least one of the tubular legs and/or at least one of the rails.

BRIEF DESCRIPTION OF THE DRAWING

The drawing is a schematic diagram of a pneumatically operated machine in accordance with an embodiment of this invention.

DESCRIPTION OF THE PREFERRED EMBODIMENTS

Referring to the drawing, an apparatus in accordance with the preferred embodiment of this invention comprises a pneumatically operated machine 11 disposed on a supporting table 13. Machine 11 may be any type of multi-function machine, for example such as those which require sequential and/or simultaneous functions to be performed on one workpiece or a plurality of workpieces located at a plurality of work stations. One example of such is an electrolytic battery assembly machine as disclosed and claimed in application Ser. No. 783,087 filed simultaneously herewith (now abandoned) and assigned to the assignee of the invention herein.

Each function of machine 11 is sequentially and/or simultaneously actuated by a plurality of independently operated air motors 15, 17, 19 which are connected to machine 11. As indicated in the drawing, the air motors may be provided in any number $N_1, N_2 \ldots N_n$, where n is any integer greater than 1. The actuation of each air motor 15, 17 and 19 is sequentially and/or simultaneously coordinated by a conventional automatically or manually controlled air valve system 20 for controlling the supplying of a predetermined air volume within a predetermined pressure range required to enable actuation of motors 15, 17, 19. A solid state programmable control system such as Model 5T1 marketed by Texas Instruments Company is an example of an acceptable automatic controller. Alternatively, the control system can be provided by relays or other types of conventional control systems.

In accordance with the features of this invention, a preferred embodiment of the machine support table 13 comprises a substantially planar top 21 supported by a plurality of tubular legs 23, 25, 27, 29. Each pair of legs is interconnected by tubular support rails 31, 33, 35, 37. Leg 23 is connected to rail 31 via a valved port 39 and to rail 37 via a similar valved port (not shown). Similarly, each of the other legs 25, 27, 29 is connected to each of the two rails 31, 33; 33, 35; 35, 37, respectively, which are adjacent to it by valved ports (not shown). Legs 23, 25, 27, 29 and horizontal support rails 31, 33, 35, 37 together form a closed and interconnected volume in which a surge tank is formed. The required volume of the surge tank is determined by the number and displacement volume of the air motors operated from the tank. The volume of the tank may be adjusted by selectively opening or closing the valved ports which interconnect each leg 23, 25, 27, 29 to each rail 31, 33, 35, 37.

A central air supply 41 for supplying air to the tank is connected into the surge tank via a port 43 in leg 23. The surge tank is, in turn, connected to control valve system 20 via a port 45 in leg 23 for providing the required air supply to enable actuation of air motors 15, 17, 19.

Table 13 is preferably made of a welded construction of such materials as metals and plastics. Conventional welding techniques are acceptable to seal the joints between the legs, rails, and top into an air-tight (except for ports) enclosure.

While the invention has been described in connection with a preferred embodiment, it will be understood by those skilled in the art that numerous modifications can be made. For example, table 13 can be constructed with any number of legs with or without support rails and with or without a top. If no top is provided, a machine could be directly mounted to the leg(s). All such modifications are intended to be included within the true spirit and scope of the invention as defined in the appended claims.

I claim:

1. A support apparatus providing both a support surface for a pneumatically operated machine and a surge tank for storing pneumatic fluid under pressure, comprising:

a support adapted to provide a suitable surface for supporting a pneumatically operated machine and pneumatically operated motors operatively coupled to the machine for imparting operative motion to the machine;

a support frame for supporting said support at a predetermined configuration, said support frame including a plurality of hollow support members which are in fluid communication with each other in an essentially air tight manner;

first conduit means leading into the hollow portions of said support frame, said first conduit means adapted to couple a source of pneumatic fluid to the hollow portions of said support frame in an essentially air tight manner; and second conduit means adapted to provide fluid communication between the hollow portions of said support frame and the pneumatically operated motors, such that said support frame not only provides mechanical support for the pneumatically operated motors and machine on said support but also provides surge tank means for the pneumatically operated motors.

2. A support apparatus according to claim 1, wherein the dimensions of the hollow portions of said support frame are proportioned to define sufficient volume to provide the required capacity of pneumatic fluid for the pneumatically operated motors.

3. A support apparatus according to claim 2, wherein said support comprises a generally planar work table top and wherein said support frame comprises a multi-leg frame of hollow legs supporting the table top.

4. A support apparatus according to claim 3, which further includes rail members extending between adjacent legs of said frame, said rail members being hollow and enabling fluid communication among the hollow portions of the legs.

5. A support apparatus according to claim 4, which further includes valved port means at the intersection of the hollow portion of each leg with the hollow portion of the rail members intersecting said leg, said valved port means being controllable for varying the interconnected volume of said hollow portions, which is in flow communication with said first and second conduit means.

6. A support apparatus according to claim 5, which further includes control valve means on said table top for coupling said second conduit means to the pneumatically operated motors, said control valve means adapted to regulate the amount of pneumatic fluid transferred from the hollow portions of said support frame to the pneumatically operated motors.

* * * * *